United States Patent [19]

Rüer

[11] 4,205,776

[45] Jun. 3, 1980

[54] SERIES OF INTERLINKED EQUALLY-SIZED PARALLELEPIPED-SHAPED FOLDING BOXES

[75] Inventor: Walther Rüer, Munich, Fed. Rep. of Germany

[73] Assignee: Refeka Werbemittel GmbH, Heimstetten, Fed. Rep. of Germany

[21] Appl. No.: 16,960

[22] Filed: Mar. 5, 1979

[30] Foreign Application Priority Data

| | | | |
|---|---|---|---|
| Mar. 3, 1978 | [DE] | Fed. Rep. of Germany | 2809231 |
| Apr. 14, 1978 | [DE] | Fed. Rep. of Germany | 2816239 |
| Oct. 30, 1978 | [DE] | Fed. Rep. of Germany | 7832310[U] |

[51] Int. Cl.[2] ..... B65D 5/08

[52] U.S. Cl. ..... 229/38; 206/602

[58] Field of Search ..... 229/38; 206/602

[56] References Cited

U.S. PATENT DOCUMENTS

| | | | |
|---|---|---|---|
| 1,184,689 | 5/1916 | Houghland | 229/38 |
| 1,630,497 | 5/1927 | Morris | 229/38 |
| 2,299,027 | 10/1942 | Novak | 229/38 UX |
| 3,092,301 | 6/1963 | Selle | 206/602 |
| 3,451,612 | 6/1969 | Sinoto | 229/38 |
| 3,542,282 | 11/1970 | Troth | 229/38 |

FOREIGN PATENT DOCUMENTS

| | | | |
|---|---|---|---|
| 2155468 | 2/1973 | Fed. Rep. of Germany | 229/38 |

*Primary Examiner*—Davis T. Moorhead

[57] ABSTRACT

An annular series of interconnected rectangular and parallelepiped-shaped folding boxes. The series includes eight interlinked parallelepipeds in two detachable sets of four successive parallelepipeds each. Individual and pairs of successive parallelepipeds are connected one to another by a flexible joint in a hinge-like manner, along mutually adjacent and equal side edges thereof. The flexible joint includes an additional wall strip disposed between mutually adjacent and equal side edges of adjoining successive parallelepipeds for interconnecting therebetween. The wall strip has a width of approximately three to five times the thickness of the cardboard material. The two outer parallelepipeds of each set of successive parallelepipeds are each detachably connected, in a hinge-like manner, by means of interengaging hook-shaped and eyelet-shaped flaps, to form an annularly closed series of parallelepipeds, which are provided each with a pair of tucked-in flaps, at least one gluing flap and at least one easily opened cover. Individuals and pairs of successive parallelepipeds are hingedly interconnected respectively one with the other by means of a gluing flap each.

25 Claims, 13 Drawing Figures

Fig.3
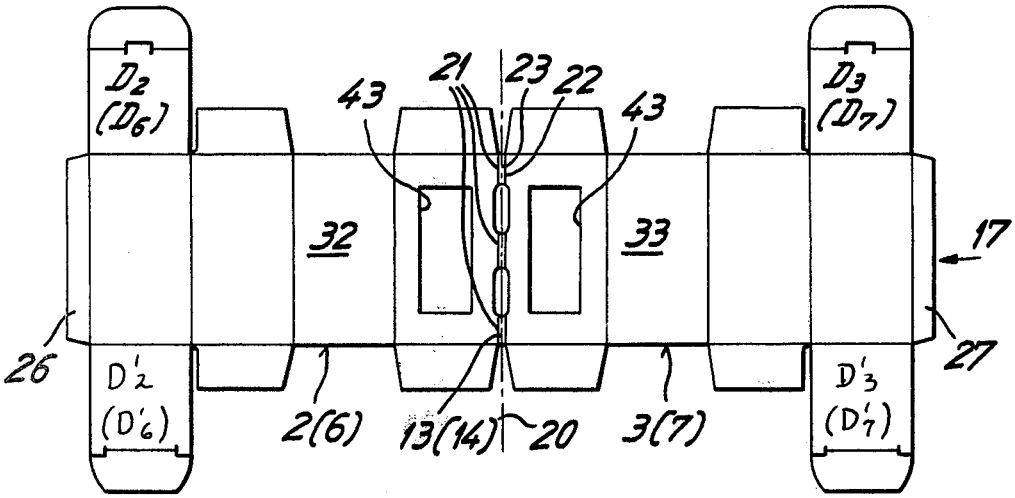
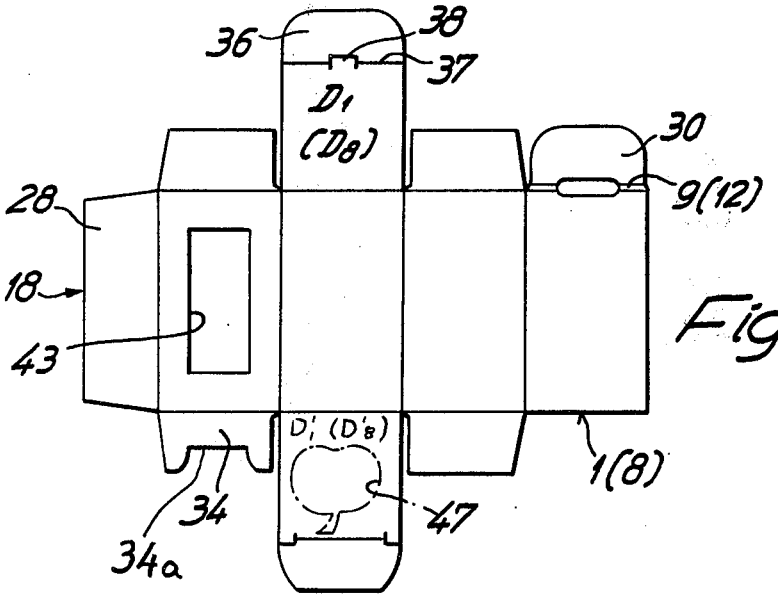
Fig.4

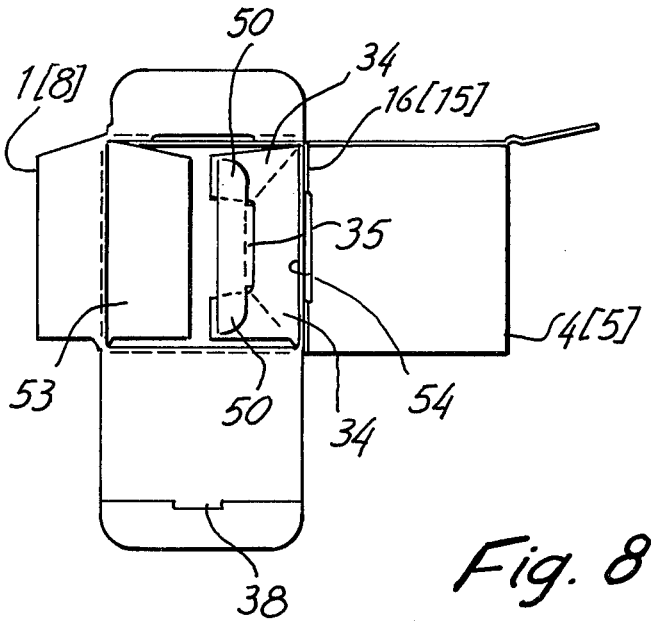
Fig. 8
Fig. 9
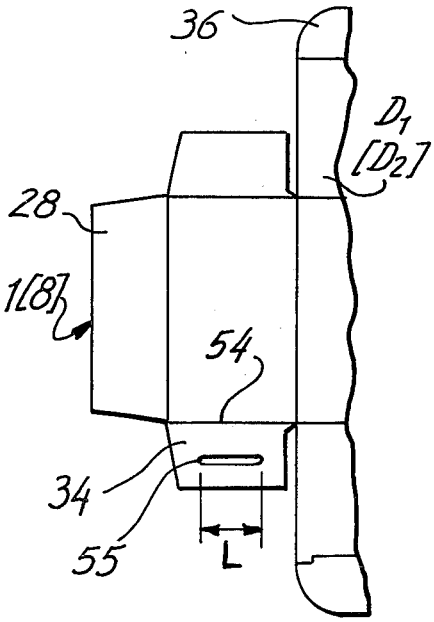
Fig. 10
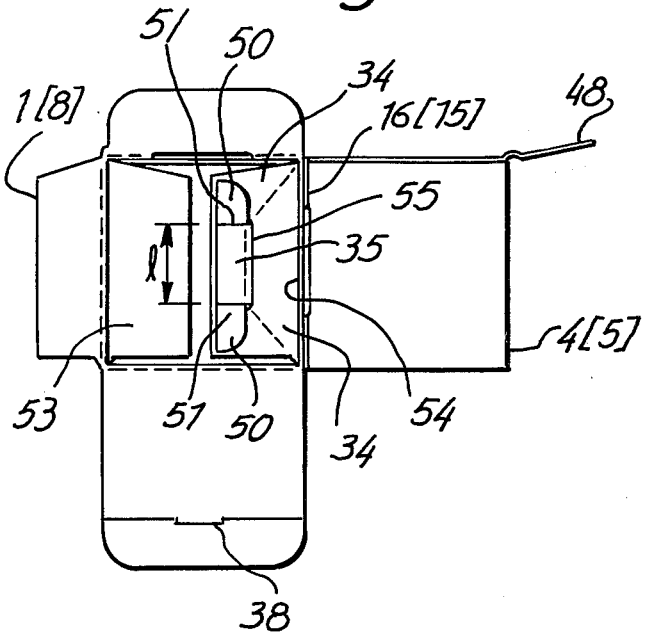

SERIES OF INTERLINKED EQUALLY-SIZED PARALLELEPIPED-SHAPED FOLDING BOXES

The present invention relates to a series of interlinked folding boxes, and in particular to a chain-like series of interlinked equal folding boxes each of which is rectangular and parallelepiped-shaped.

Series of interconnected folding boxes have been described in the art and have been known for many years, as illustrated in German U.M. Pat. No. 6,900,177. The various known series have undergone extensive improvements during the years, especially as it relates to the method of producing the same as illustrated in German Pat. No. 2,155,468. The known series of interlinked folding boxes use cube-shaped boxes or bodies and are distributed as toys, advertising articles and sales packaging.

The underlying objective of the invention is to improve the known series of interlinked folding boxes and to resolve long-standing problems in the art, so that the improved series is particularly suitable for use in sales and merchandise packaging.

The present invention contemplates the formation of an annularly closed series of interconnected folding boxes each of which is equal in size and having the shape of a rectangular parallelepiped.

The invention provides for eight equally-sized, rectangular and parallelepiped-shaped boxes to be folded together in sequence from two sets of prefolded cardboard cut-outs or blanks, each folding box or parallelepiped being provided with at least a pair of tucked-in flaps, one gluing flap and one cover which can be easily swung up and opened.

An important object of the invention is to provide for individual successive parallelepipeds to be interconnected by a hinge-like flexible joint along respective mutually adjacent and equal side edges thereof. In addition, each pair of successive parallelepipeds is interlinked by means of a hinge-like flexible joint to another pair of successive parallelepipeds along mutually adjacent and equal side edges of respective parallelepipeds, to form a set of successive parallelepipeds. A series of parallelepipeds is formed by interlinking two sets of successive parallelepipeds.

In the known series of interlinked cube-shaped boxes, which are folded up from cardboard cut-outs or blanks, the hinge-like connecting points between the cubes consist either of separate adhesive bond strips which were difficult to apply, or of parts of cardboard material which are connected via a folding edge. The latter gets either easily torn apart as a direct result of prescribed perforations, or remains too rigid and inflexible, so that the series does not obtain the desired chain form.

In accordance with the present invention, the series is provided with hinge-like flexible joints disposed between individual parallelepiped and pairs of parallelepipeds. Each flexible joint consists of a wall strip disposed between adjacent side edges of interlinked parallelepiped. Each wall strip may be divided by an elongated slot (or two slots) into connecting links located at the opposite ends of the connected side edges. Although these joints are quite flexible, they are also adequately reliable and durable even after frequent and extensive use, as for instance in converting the arrangement of the parallelepipeds into varied shapes for the overall body.

According to the prior art, the interlinked folding boxes could only be shaped in cube form and provided with completely identical outer surfaces in order for them to be arranged (or transformed) into particularly shaped overall bodies. This was necessary in the prior art because the cube-shaped boxes could always support one another, in any overall body arrangement, by virtue of their equal surfaces.

However, in accordance with the present invention, also rectangular boxes or parallelepipeds, other than cube-shaped, having pairs of outer surfaces or sides of different sizes, can be interlinked even in a chain-like (known) manner to form an even greater number of folding box arrangements and obtain greatly varied shapes of overall bodies.

In providing this greatly improved transformation effect, the invention constitutes an improvement over the prior art. Furthermore, the parallelepiped form (other than the cube form) is largely adaptable to changes in shape and size for accommodating any particular sales or merchandise article to be received therein, for instance, small toys or bar-shaped chocolates.

The main objective of the invention is accomplished in an advantageous manner by the particular construction of the series of interlinked rectangular or parallelepiped-shaped folding boxes, which forms a parallelepiped-shaped overall body. When in this formation, all covers of the individual parallelepipeds lie in one common plane, the top side (plane) of the parallelepiped-shaped overall body. The latter can be conveyed in a simple manner to a conventional filling device, by means of which the individual interlinked boxes or parallelepipeds can easily be filled, one after another, in a row, or all light boxes or parallelepipeds (with their covers in open position) filled simultaneously in a single pass through the filling device.

Furthermore, in the known series of cube-shaped interlinked folding boxes, the coupling members interlinking sets of folding boxes, are deficient and lack the means of assuring a sufficiently dependable coupling connection. The known coupling members include a hook member of such shape that it allows for excessive flexibility at the joint. The hook-shaped coupling member makes large swinging movements with respect to the other coupling member, that are harmful to the joint interaction of the individual boxes. The problem, therefore, confronted in the prior art, and left unresolved up to the present invention, was the formation or design of coupling members such that when disposed between articulately joined sets of rectangular boxes or individual boxes, the relative displacements of the coupling members therebetween (due to the normal strains in use of rectangular boxes) are prevented as far as possible.

The present invention has also resolved the aforementioned problem by providing for a hinge-type joint or coupling connection that is reliable and effective in linking individual as well as sets of parallelepipeds.

For interlinking sets of parallelepipeds, the invention provides for a particular detachable hinge-type coupling connection. Special foldable flaps—eyelet and hook-shaped—are formed integrally in respective outer parallelepipeds of each set. The eyelet and hook-shaped flaps of respective outer parallelepiped are interengaged to form a flexible and reliable hinge-type joint between two sets of successive parallelepipeds.

A further objective of the present invention is to provide for the linked parallelepiped to be arranged into a parallelepiped-shaped overall body such that the latter has two hinge-like flexible joints disposed on its top side (in a common transverse direction) at each of the opposing longitudinal ends thereof, between the outermost pairs of parallelepipeds and adjoining inner pairs of parallelepipeds.

By providing for the outer pairs of parallelepipeds of the overall body to be respectively folded by 180° toward the two inner pairs of parallelepipeds, the regular parallelepiped-shaped overall body is converted into a particularly shaped parallelepiped body that is especially suitable for shipping and for gift packaging.

The parallelepiped-shaped overall body can be secured for shipping in a rather simple manner, by attaching or affixing small adhesive sheets, one of each at the top and bottom of the overall body. The point of affixing the adhesive sheets to the body should be at the middle section thereof, which consists of four parallelepipeds. The adhesive sheets should cover the four corners facing one another of that section.

Additional objectives and features of the invention will be described and explained further below.

The present invention is further illustrated and shown by means of the following drawings:

FIG. 1 is a perspective view of the series of interlinked rectangular boxes or elongated parallelepipeds provided with square end surfaces or cover sections. This view also shows the series arranged in the shape of a horizontal extending parallelepiped-shaped overall body.

FIG. 2 is a perspective view of the series shown in FIG. 1. However, the arrangement of the parallelepipeds is changed to form a vertically extending parallelepiped-shaped overall body. This view also shows respective covers illustrated in FIG. 1 as concealed by adjacent parallelepipeds.

FIGS. 3, 4 and 5 show, respectively, three spread-out cardboard cut-outs or blanks used for formation of a single set of successive parallelepipeds, of the two identical sets forming the parallelepiped series of the present invention.

FIG. 8 is a partial plan view of two coupled outer parallelepipeds belonging to two different sets. The Figure illustrates the interengagement of flaps 34 and 35.

FIG. 9 is a partial plan view of the carboard cut-out or blank serving for the formation of two parallelepipeds, and especially for illustrating a further embodiment of the eyelet-shaped flap 34.

Figure 11:
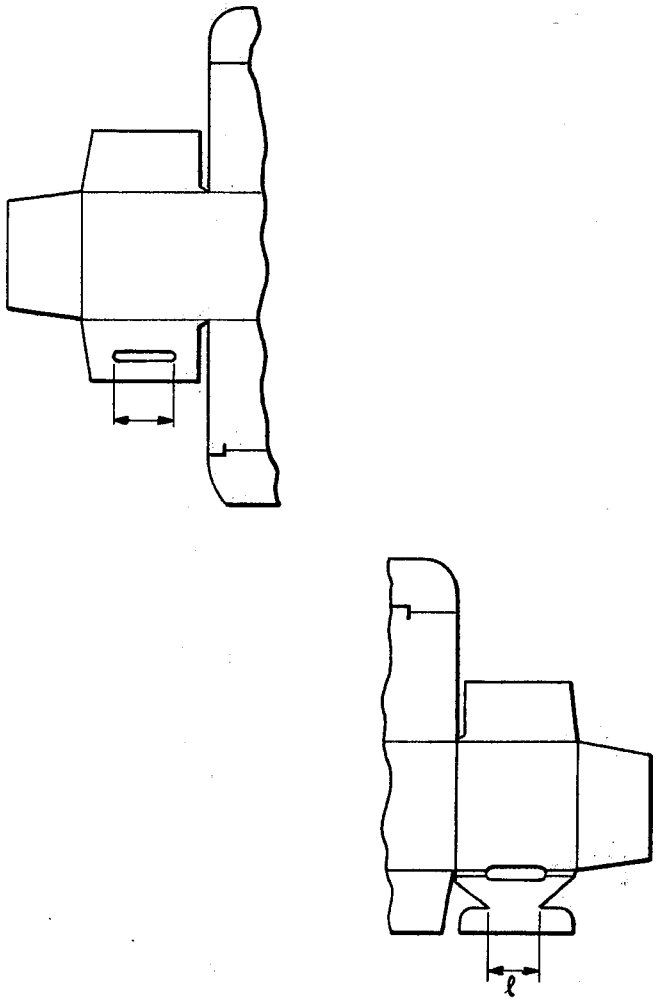
Figure 13:
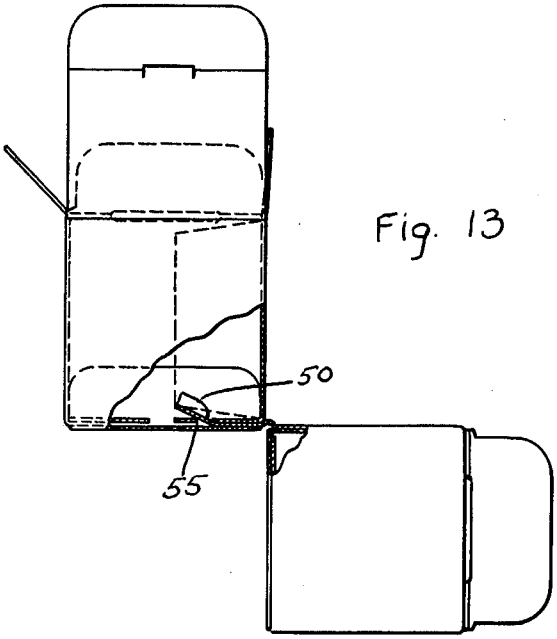
Figure 12:
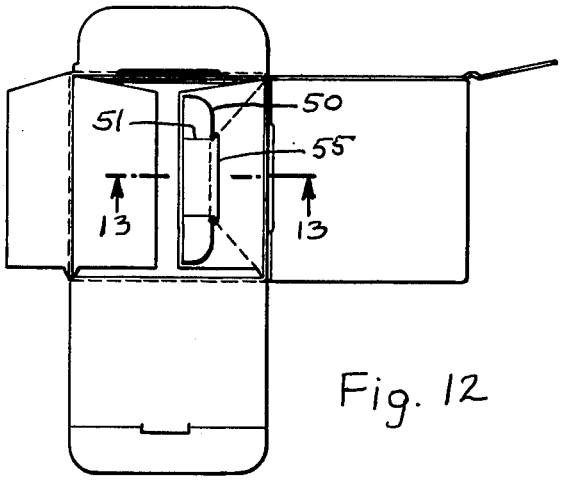

FIG. 10 is a partial plan view of two coupled outer parallelepipeds belonging to two different sets. The Figure shows the interengagement of another embodiment of flaps 34 and 35. FIGS. 11–13 are further views of same embodiment.

The following constitutes a detailed description of the various features, elements and general construction of the invention.

Figure 1:
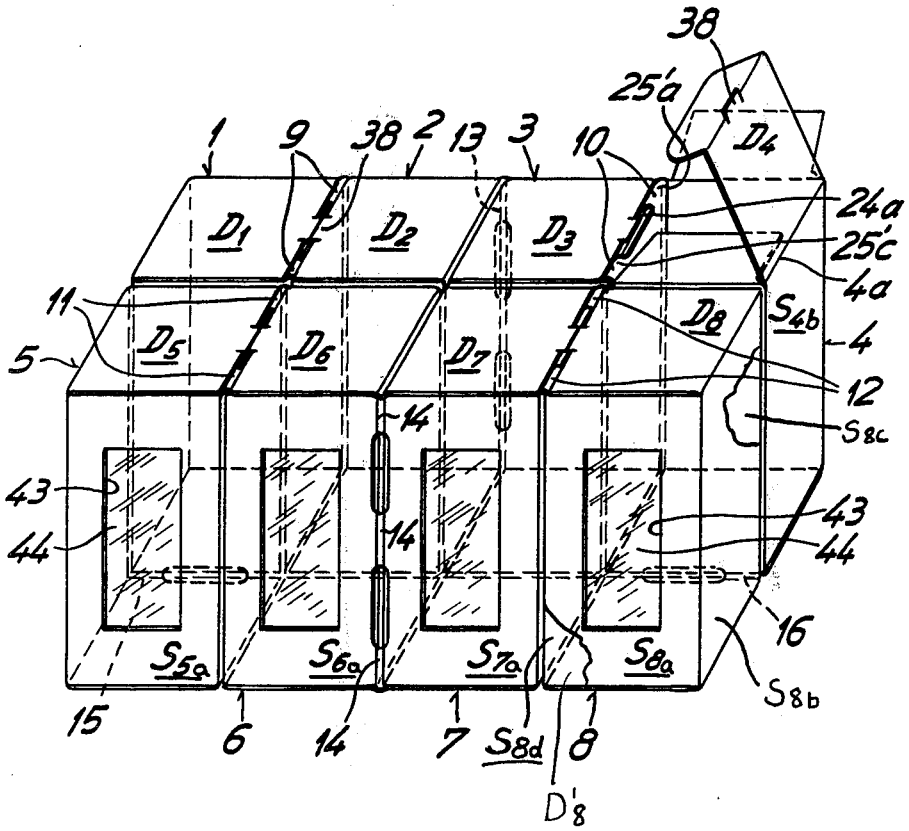

In FIG. 1, there are illustrated the eight parallelepipeds 1–8 of the annularly closed series of the invention. The individual parallelepiped may have any rectangular shape, with three pairs of respectively identical, opposite side walls. Each parallelepiped consists of an elongated rectangular body provided with a square cover section $D_1$–$D_8$ (which is equal in size to a bottom section $D'_1$–$D'_8$ of which only bottom section $D'_8$ is shown in FIG. 1), and four rectangular side walls $S_{1a-d}$–$S_{8a-d}$, that are equal in size and of which side walls $S_{4b}$, $S_{5a}$, $S_{6a}$, $S_{7a}$, $S_{8a}$, $S_{8b}$, $S_{8c}$ and $S_{8d}$ of parallelepipeds 4–8 are shown in FIG. 1. The parallelepipeds 1–8 are interconnected in sequence and arranged, as shown in FIG. 1, to form a parallelepiped-shaped overall body of a form similar to that of an individual parallelepiped.

The parallelepiped series consists of two sets of interlinked successive parallelepipeds, each set having four parallelepipeds. As illustrated in FIG. 1, one parallelepiped set includes parallelepipeds 1 to 4 and the second set includes parallelepipeds 5 to 8.

Figure 5:
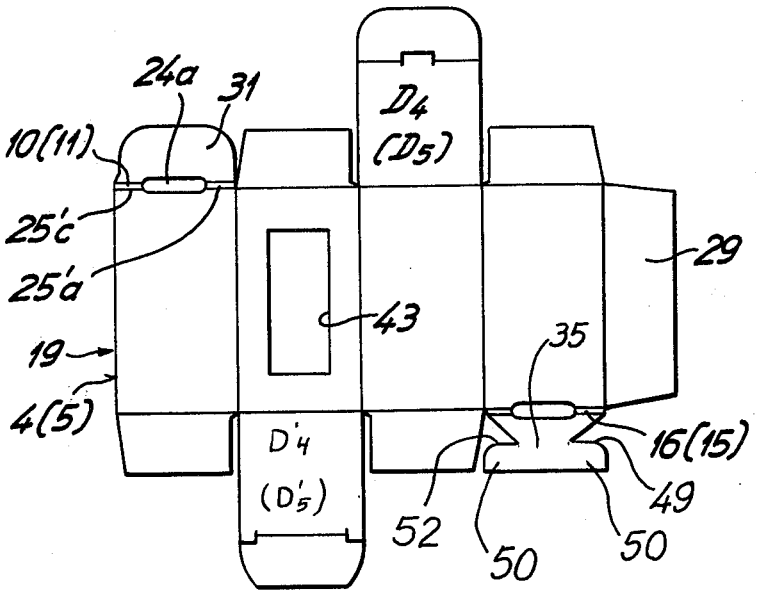

Each parallelepiped set is folded together from three cardboard cut-outs or blanks 17, 18 and 19 (compare FIGS. 3, 4 and 5). The cardboard cut-out or blank 17 can be folded together to form two successive parallelepipeds, i.e., 2 and 3, of the one set, or 6 and 7 of the other set. Each of the cardboard cut-outs or blanks 18 and 19 can be folded together to form an additional parallelepiped, i.e., 1 or 8 of the one set, and 4 or 5 of the other set.

Cardboard cut-out 17 is formed symmetrically about its middle transverse axis 20, and incorporates three hinge-like flexible joints 13 or 14, respectively. The flexible joints 13 or 14 (as is the case with other flexible joints 9, 10, 11, 12, 15 and 16 of the parallelepiped series) consist of an additional wall strip 23 located between the connected side edges 21 and 22 of parallelepipeds $S_6$ and $S_7$, respectively. Side edges 21 and 22 are formed in conventional manner by folding the side wall along its respective folding line (See FIGS. 2 and 3). The additional wall strip 23, which has a width corresponding to about four times the wall thickness of the cardboard material, incorporates sufficient material between the side edges 21 and 22, so as to absorb the articulation movements between adjacent parallelepipeds, without using or bringing into play for that purpose, the cardboard material of the parallelepipeds proper. The wall strip 23 is divided along the side edges 21 and 22 by two elongated slots 24 (which are arranged longitudinally one next to the other) into three connecting links $25_a$, $25_b$ and $25_c$, each one of which forms an integral part of a flexible hinge-like joint 13 or 14 (See FIG. 2).

It should be pointed out that, as regards flexible joints 9–12, the wall strip 23 is divided by a single elongated slot $24_a$ (extending longitudinally through the middle region of the connected side edges), into two connecting links $25'_a$ and $25'_c$ (See FIGS. 1 and 5), located at the two opposing ends of the connected side edges 21 and 22.

The flexibility of the flexible joints 9–16 is further increased due to the fact that the width of the elongated slots 24 or $24_a$ is approximately two to three times greater than the width of the wall strip 23.

The increase in flexibility of the joints manifests itself as follows.

Upon folding and arranging the interlinked series of folding boxes or parallelepipeds in an overall parallelepiped-shaped body, the outer pairs of the folding boxes or parallelepipeds, 1, 5 and 4, 8 (as shown in FIG. 1) engage or position themselves by their own weight aside the inner pairs of folding boxes or parallelepipeds, to form a parallelepiped-shaped overall body (as shown in FIG. 1).

The overall body is easily formed even with empty folding boxes.

This type of construction is important because the series of interlinked folding boxes or parallelepipeds (of the present invention), when arranged in the form of a single parallelepiped-shaped overall body (as shown in FIG. 1), must be movable through a filling device with only simple conventional holders, if the individual folding boxes or parallelepipeds are to be filled by means of the filling device in a simple manner in a single pass.

Moreover, in order to facilitate this filling operation, it is important that the folding boxes or parallelepipeds 1–8, all have covers $D_1$ to $D_8$, which can be easily opened upwardly (at least in one position) when the parallelepipeds are arranged as a single overall parallelepiped body. This is illustrated in FIG. 1 where all eight parallelepipeds are shown to be interlinked in sequence one next to the other, and all the covers lie in a single common plane, the top section of the overall body.

According to the present invention, placing the covers in this accessible position $D_1$–$D_8$, comes about by itself during the folding together and assembly of the cardboard cut-outs or blanks 17, 18 and 19, which is further described below.

In order to assemble or fold together the two parallelepipeds of each cardboard cut-out or blank 17, the two outer gluing flaps 26 and 27 are glued together after folding up the two cut-out or blank ends against the respective assigned side walls of parallelepipeds 2 or 3, adjoining both sides of the hinge-like flexible joint 13. In the same manner, parallelepipeds 1 and 4 are folded together by means of one gluing flap each, 28 and 29, and are connected to the adjoining side wall 32 or 33, respectively, of parallelepiped 2 or 3, respectively (see FIG. 3), by means of a single outwardly projecting gluing flap each, 30 or 31, respectively, which simultaneously forms a hinge-like moving joint 9 or 10, respectively. In the process, an additional flap 34, which can be folded into the assembled parallelepiped 1, is formed as an eyelet-shaped section, while the assembled parallelepiped 4, in addition to gluing flap 31, is provided with a hook-shaped outwardly projecting flap 35.

As seen from FIG. 5, flap 35 is provided with a pair of hook portions 50, oppositely disposed and projecting outwardly from the middle section of the flap. The hook portions 50 are defined by a pair of oppositely disposed recesses 49 which are shaped in the form of right triangles having hypotenuses running from the outer ends of flexible joint 16 to the inner ends of hook portions 50. It is preferable that the outer ends of the substantially rectangular hook portions 50 be rounded at their corners 52, facing the recesses 49, or joint 16.

As seen from FIG. 4, flap 34 is provided with an outwardly opened recess 34*a* for interengaging with hook portions 50. It is preferable that flap 34 have a dimension equal to approximately one-half of the opening surface of a parallelepiped.

The flap 35 is connected to parallelepiped 4 via the flexible joint 16, of which the flap is an integral part. Parallelepipeds 1 and 8 of the series are provided each with the eyelet-shaped flap 34, and parallelepipeds 4 and 5 are each provided with an "engaging section'-'—the hook-shaped flap 35.

For example, flap 35 constituting the "engaging section" of one parallelepiped set 1–4 (or parallelepiped 4) could, by engaging the eyelet-shaped flap 34 of the other set 5–8 (or parallelepiped 8), interconnect both sets of parallelepipeds. In this manner, the two parallelepiped sets (having the respectively undetachably connected parallelepipeds 1 to 4 or 5 to 8) can be detachably connected together by their outer parallelepipeds to form an annularly closed series.

FIG. 8 illustrates in a plan view, the manner of interlinking two outer parallelepipeds 1 (8) and 4 (5) (of two different sets of parallelepipeds) by interengaging respective flaps 35 and 34. It should be stressed that, before flap 35 is inserted into flap 34, the latter is folded inwardly into its respective parallelepiped.

The present invention provides also a further embodiment of the coupling members, i.e., flaps 34 and 35.

In accordance with the further embodiment, as illustrated in FIG. 9, eyelet-shaped flap 34 consists of an integral section having in its middle zone, an oblong slot 55, which has a width dimension approximately twice as large as that of the thickness of the cardboard material, and which runs parallel to the flaps base edge 54. Another flap 53 lies oppositely adjacent to flap 34—in the same parallelepiped. In this embodiment, the hook-shaped flap 35 is provided with a pair of parallel folding edges 51 running in a direction transverse to joint 16 (15) and to each of the hook portions 50. The folding edges 51 make possible the folding of hook portions 50 one against another, and defines a spacing length dimension l (See FIG. 10) that is somewhat smaller from spacing length dimension L (See FIG. 9) of the oblong slot 55.

The interengaging of the coupling members, i.e., flaps 34 and 35, can take place with completely or nearly folded parallelepipeds 1 (8) and 4 (5).

As illustrated in FIG. 10, the hook-shaped flap 35 projecting outwardly from the folded parallelepiped 4, is inserted with its hook portions 50 folded one against the other (through 180°) through the oblong slot 55, and then hook portions 50 are swung back outwardly to secure the flaps' linkage about the oblong slot 55.

FIG. 10 shows that the interengagement of the two coupling members produces a reliable and effective hinge-type joint that can handle all normal strains in the series of interlinked parallelepipeds.

The present invention provides, on the one hand, the advantage of connecting together the eight successive parallelepipeds in an easily detachable manner to form a chain-like series of parallelepipeds. On the other hand, the invention provides the further advantage that, if desired, each parallelepiped set can also form a complete series or sales packaging of its own. In the latter case, it is only necessary to fold the flaps 34, 35, completely inside their respective parallepipeds (1, 8 or 4, 5).

The covers $D_1$ to $D_8$, which also serve for subsequent access to the contents of the parallelpipeds, can be easily opened or swung up, out of their closed position.

Figure 2:
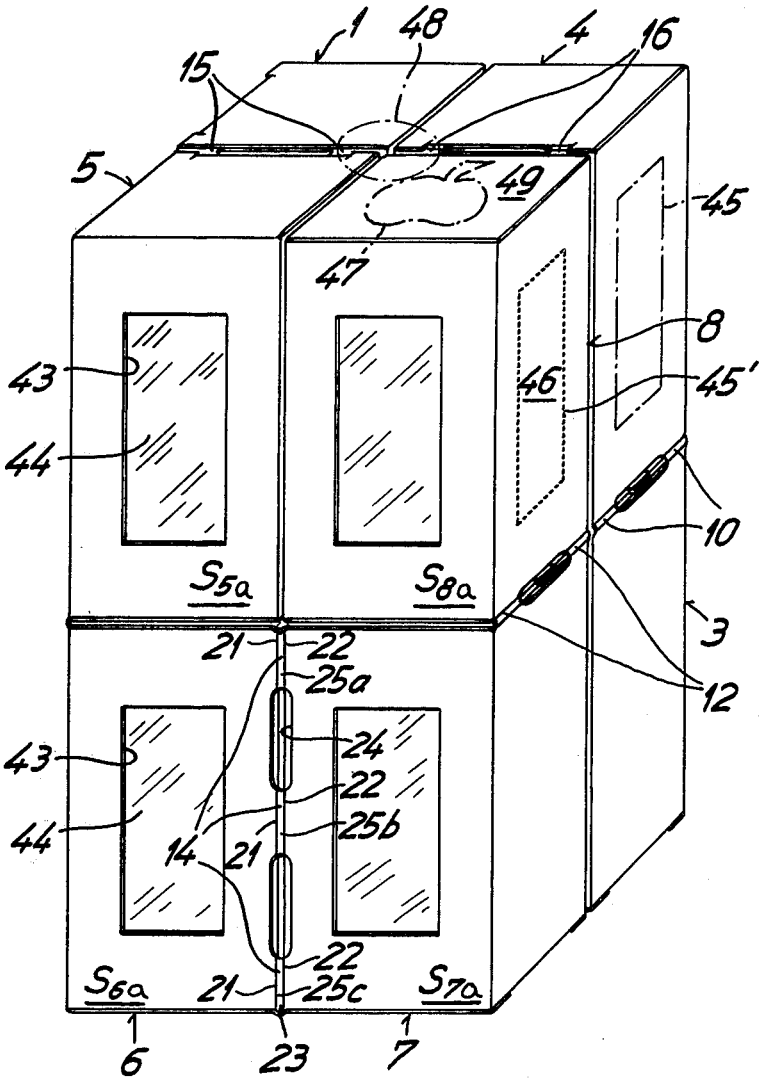

Each one of the covers, in the middle section of their side edge 37 (See FIG. 4), which turns into a tucked-in flap 36 (which at the same time also forms a fold line), has a gripping tab 38, stamped out of the cardboard material of the tucked-in flap 36, and projecting outwardly beyond the side edge 37. In addition, as illustrated in FIG. 2, the front and back side walls of the individual parallelepipeds 1 to 8 (of which side walls $S_{5a}$–$S_{8a}$ are shown in FIGS. 1 and 2) are each provided with a window cut-out 43, which is expediently covered by a glued-in transparent film 44, to form a see-through window. There could also be provided additional window cut-outs as shown, in FIG. 2, on parallelepiped 4 (indicated by a dash-dot line 45). In addition to these windows, or in their place, the present invention provides for removable wall sections 46 which can be removed from each side wall along perforations 45' circumscribing the sections 46.

Furthermore, window cut-outs could also be provided in irregular forms such as, for instance, fruits or flowers. This is illustrated in FIG. 2, with window cut-out 47 in the form of a cherry circumscribed or defined by a dash-dot line.

In case of filling, for commercial use, the boxes or containers of the parallelepiped series, the latter could be arranged to form a parallelepiped-shaped overall body, as illustrated in FIG. 2, in which the covers $D_1$ to $D_8$ all lie inaccessibly concealed within the transverse plane of the overall body. It should be pointed out that the overall body could, in a simple manner, be held together or secured for shipment by the use of round and small adhesive sheets 48. While the adhesive sheets 48 may have a round outline as depicted, they may also have any other suitable outline or configuration. The sheets may be small or large in dependence on the size of the parallelepiped series or overall body. Each adhesive sheet 48 is attached to the top and bottom sides of the overall body at the middle section thereof. As shown in FIG. 2, an adhesive sheet 48 may cover the mutually facing four corners of the four parallelepipeds 1, 4, 5 and 8, or 2, 3, 6 and 7, respectively, located at the bottom.

Figure 7:
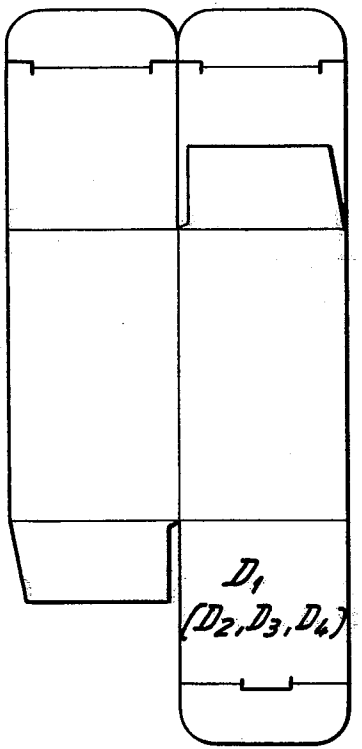
FIG. 7 is an elevational view of the parallelepiped set shown in FIG. 6 in the direction of arrow VII therein. This view shows the parallelepiped set after a complete flattening out and folding together ready for shipping.
Figure 6:
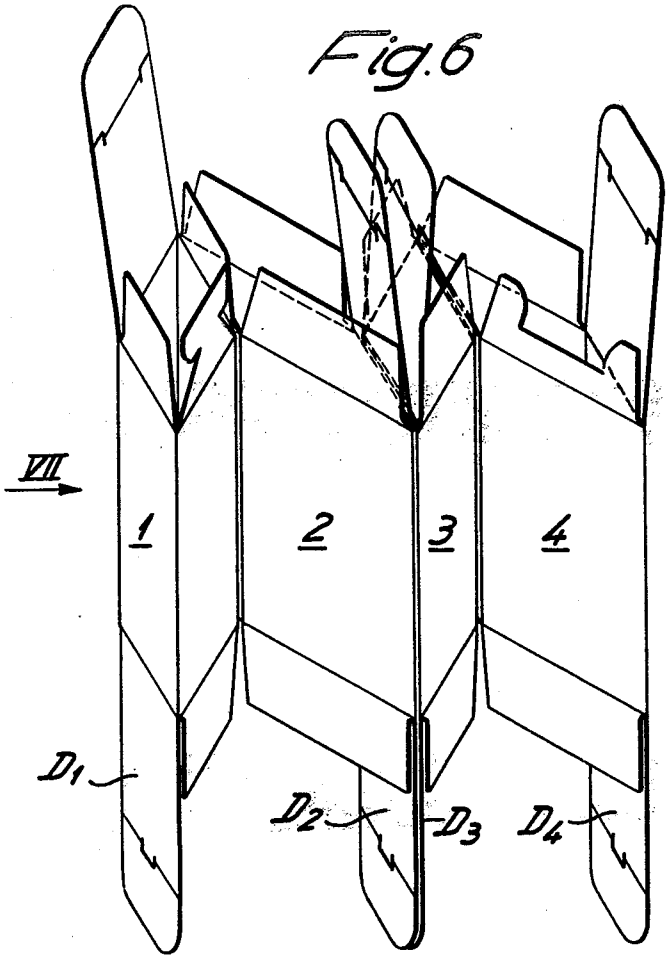
FIG. 6 is a perspective view of a partially folded-up set of successive parallelepipeds of the series of the invention.

For the practical use of the parallelepiped series, as described above, it should be noted that it can be shipped under the most favorable freight conditions, i.e., folded together in a space saving manner, from the packaging manufacturer to the first customer (who can fill the individual boxes or parallelepipeds with merchandise or other articles). It has been proven advantageous for this purpose, to prefabricate to two parallelepiped sets in the manner shown in FIG. 6. The sets can be easily assembled, rendering the same completely glued and folded flat together in the manner illustrated in FIG. 7, with flaps and covers, respectively, folded up into the plane of the adjacent side wall. The first customer or user needs only to set up or fold up the parallelepiped sets (which are laid flat together in the above-described manner) into a series of interlinked successive parallelepiped-shaped hollow containers. The individual containers can easily be closed up by folding in or bending inwardly corresponding flaps and covers thereof.

For interlinking or connecting parallelepiped sets that belong together, it is only necessary to bring together, in the above-described manner, the eyelet and hook-shaped flaps 34 and 35, respectively (as can be seen in FIGS. 8 and 10).

The width of the wall strips 23, which, respectively, form a hinge-like flexible joint described with a dimension of four times the thickness of the cardboard material, may also be enlarged to approximately three to five times the thickness of the same.

No matter what particular embodiment or design is chosen for the hinge-like flexible joints 9–12, etc., they will advantageously provide for adequate utilization of the parallelepiped series. In case thinner than usual cardboard material is used in making the parallelepipeds and the wall strips 23, the hinge-like flexible joints can retain their flexibility by dispensing with the formation or stamping out of elongated slots 24 in wall strips 23.

What is claimed is:

1. An annularly closed series of interlinked folding boxes comprising, eight equally-sized, rectangular and parallelepiped-shaped boxes which are interconnected and folded together in sequence from prefolded cardboard blanks, in two detachable sets of four successive parallelepipeds each, individual parallelepipeds are each provided with three pairs of respectively identical opposite side walls, each parallelepiped of a pair of successive parallelepipeds is connected to the other parallelepiped by a flexible joint in a hinge-like manner along mutually adjacent and equal side edges thereof, in a similar manner, each pair of successive parallelepipeds is hingedly connected by a flexible joint to another pair of successive parallelpipeds at mutually adjacent and equally-sized side edges of respective parallelepipeds so as to form a set of successive parallelepipeds, the latter side edges being further away from the former side edges and in a plane which is transverse to the plane of the former side edges, said flexible joint comprising an additional wall strip having a width of approximately three to five times the thickness of the cardboard blank material and disposed between the mutually adjacent and equal side edges of adjoining successive parallelepipeds for interconnecting therebetween, and the two outer parallelepipeds of each set of successive parallelepipeds are each connected in a hinge-like manner to corresponding outer parallelepipeds of the other set at mutually adjacent and equal side edges thereof so as to form an annularly closed series of parallelepipeds, which are provided each with a pair of tucked-in flaps, at least one gluing flap and at least one easily opened cover and individuals and pairs of successive parallelpipeds are hingedly interconnected respectively one with the other by means of a gluing flap each.

2. The series according to claim 1, in which at least two pairs of the identical opposite side walls of each parallelepiped have a rectangular form differing from a square.

3. The series according to claim 2, in which each wall strip situated between the long edges of two side walls having a rectangular form differing from a square is divided by two elongated slots, which are arranged longitudinally one next to the other, into three connecting links of which two are arranged at the upper and lower ends and one in the middle section of the connected side edges of respective parallelepipeds.

4. The series according to claim 1, in which each wall strip situated between two side walls of adjacent cube shaped boxes is divided by an elongated slot into two connecting links located at the upper and lower ends of the mutually adjacent and equal side edges of respective parallelepipeds.

5. The series according to claim 3, in which each elongated slot has a width of approximately two to three times as great as the associated wall strip.

6. The series according to claim 4, in which each elongated slot has a width of approximately two to three times as great as the associated wall strip.

7. The series according to claim 1, in which the interconnected parallelepipeds are arranged in sequence one next to the other to form a parallelepiped-shaped overall body and easily opened covers of all lie in the same plane at the top of the body.

8. The series according to claim 2, in which each of the covers constitutes one of the two smallest outer surfaces of its respective parallelepiped.

9. The series according to claim 8, in which respective covers are swingable around the side edges of respective parallelepipeds at the outside of the overall body and in a direction parallel to the narrow side thereof.

10. The series according to claim 7, in which the parallelepiped-shaped overall body has two hinge-like flexible joints disposed on its top side, at each of the opposing longitudinal ends thereof, between the outermost pairs of parallelepipeds and the adjoining inner pairs of parallelepipeds, the latter being disposed towards the middle of the top side, and one hinge-like flexible joint, respectively, each between both middle points at the outside of the overall body.

11. The series according to claim 1, in which the eight parallelepipeds are interconnected and folded up from two identical sets of three cardboard blanks, each three blanks forming a set, one blank can be folded up into two successive parallelepipeds and each of the other two blanks can be folded up so as to form one additional parallelepiped.

12. The series according to claim 11, in which the cardboard blank which can be folded up into two successive parallelepipeds is formed symmetrically about its middle transverse axis incorporating a hinge-like flexible joint which can connect two adjoining successive parallelepipeds.

13. The series according to claim 11, in which one of the two outer parallelepipeds of each set is provided with a hook-shaped flap and the other with an eyelet-shaped flap, the outer parallelepipeds of one set interlinking with respective outer parallelepipeds of the other set by engaging respective hook-shaped flaps with respective eyelet-shaped flaps so as to form an annularly closed series of successive parallelepipeds.

14. The series according to claim 1, in which each cover is provided at the middle section of its side edge with a gripping tab punched-out of the cardboard material of the tucked-in flap, the gripping tab projecting outwardly beyond the side edge.

15. The series according to claim 1, in which at least one parallelepiped has a side wall provided with a window cut-out.

16. The series according to claim 15, in which the window cut-out has an irregular form and may assume the shape of a fruit or flower.

17. The series according to claim 15, in which at least a portion of the window cut-out is covered by a glued-in transparent film so as to form a see-through window.

18. The series according to claim 1, in which at least one parallelepiped has a side wall provided with a removable wall section circumscribed by perforations.

19. The series according to claim 15, in which a window cut-out is provided in that side wall of each of the outer parallelepipeds of each set, which lies opposite to the cover side.

20. The series according to claim 18, in which a removable wall section is provided in that side wall of each of the outer parallelepipeds of each set, which lies opposite to the cover side.

21. The series according to claim 1, in which the interlinked successive parallelepipeds are arranged to form a parallelepiped-shaped overall body and the covers of the parallelepipeds are inaccessible and concealed within the transverse plane of the overall body, and in which the overall body is secured for shipment by means of adhesive sheets attached to the top and bottom of the body and disposed at the middle sections thereof for covering mutually-facing four covers of the four respective parallelepipeds located therein.

22. The series according to claim 13, in which the hook-shaped flap comprises a pair of oppositely disposed hook portions and the eyelet-shaped flap comprises an outwardly open recess for interengaging with said hook portions.

23. The series according to claim 13, in which the eyelet-shaped flap comprises an integral member having in its middle zone, an oblong slot of a width approximately twice as large as that of the thickness of the cardboard blank, said oblong slot running parallel to the flap's base edge, and in which the hook-shaped flap comprises a pair of oppositely disposed and foldable hook portions and a pair of folding edges running transversely to said hook portions defining a spacing length dimension that is smaller than the length dimension of the oblong slot, and making possible the folding of said hook portions one against another through 180° from the flap's base edge, so that said hook portions can be inserted into the oblong slot for interengagement of the hook and eyelet-shaped flaps.

24. The series according to claim 23, in which the hook portions are defined by a pair of oppositely disposed recesses, which are shaped in the form of a right triangle having an hypotenuse running from the outer end of the flexible joint to the inner end of a respective hook portion.

25. The series according to claim 24, in which said hook portions are substantially rectangular, to the exclusion of the corners thereof facing said oppositely disposed recesses, which corners are rounded.

* * * * *